US011459677B2

(12) United States Patent
Kashima et al.

(10) Patent No.: US 11,459,677 B2
(45) Date of Patent: Oct. 4, 2022

(54) WEFT-KNITTED FABRIC

(71) Applicant: Asahi Kasei Kabushiki Kaisha, Tokyo (JP)

(72) Inventors: Norito Kashima, Tokyo (JP); Yusuke Kikuyama, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/269,427

(22) PCT Filed: Aug. 28, 2019

(86) PCT No.: PCT/JP2019/033795

§ 371 (c)(1),
(2) Date: Feb. 18, 2021

(87) PCT Pub. No.: WO2020/045531

PCT Pub. Date: Mar. 5, 2020

(65) Prior Publication Data

US 2021/0180222 A1 Jun. 17, 2021

(30) Foreign Application Priority Data

Aug. 28, 2018 (JP) ..... JP2018-159123

(51) Int. Cl.
*D04B 1/18* (2006.01)
*D04B 1/10* (2006.01)
*D04B 1/24* (2006.01)

(52) U.S. Cl.
CPC ..... *D04B 1/18* (2013.01); *D04B 1/102* (2013.01); *D04B 1/24* (2013.01)

(58) Field of Classification Search
CPC ..... D04B 1/104; D04B 1/18; D04B 1/126; D04B 4/24; D04B 9/26; D04B 9/46
See application file for complete search history.

(56) References Cited

U.S. PATENT DOCUMENTS 2,127,780 A * 8/1938 Loyn ..... D04B 9/54 66/172 E
2,269,088 A * 1/1942 Fleer ..... D04B 39/04 66/172 R
2,584,834 A * 2/1952 Bevins ..... A41B 3/00 66/176
5,149,583 A * 9/1992 Saarikettu ..... D04B 1/123 442/312
6,082,145 A * 7/2000 Lonati ..... A41C 3/0007 66/176

(Continued)

FOREIGN PATENT DOCUMENTS

EP 0053431 A1 6/1982
JP H02-000308 U 1/1990

(Continued)

OTHER PUBLICATIONS

International Search Report issued in corresponding International Patent Application No. PCT/JP2019/033795 dated Nov. 19, 2019.

(Continued)

*Primary Examiner* — Danny Worrell
(74) *Attorney, Agent, or Firm* — Morgan, Lewis & Bockius LLP

(57) ABSTRACT

Provided is a weft-knitted fabric having excellent stretchability, and providing excellent comfort in a hot environment. The weft-knitted fabric contains non-elastic fibres and elastic fibres, and is characterised: by being formed of a mesh part where a stitch of a welt structure and a stitch of a knit structure are alternately repeated to complete one course, and the course having the same structural arrangement is employed once or continuously repeated twice, and a plain-knit part where a course of an all-knit structure is employed once or continuously repeated up to three times; and in that said mesh part and said plain-knit part are each alternately arranged in the longitudinal direction.

9 Claims, 7 Drawing Sheets

(56) References Cited

U.S. PATENT DOCUMENTS

| | | | | |
|---|---|---|---|---|
| 6,272,888 | B1 * | 8/2001 | Fujita | D04B 1/243 66/172 E |
| 10,889,923 | B2 * | 1/2021 | Diaz | A41D 27/28 |
| 10,988,871 | B2 * | 4/2021 | Fuhrmann | D04B 1/108 |
| 2002/0152775 | A1 | 10/2002 | Browder, Jr. | |
| 2003/0131634 | A1 * | 7/2003 | Sciacca | D04B 1/24 66/64 |
| 2006/0223400 | A1 | 10/2006 | Yasui et al. | |
| 2016/0040328 | A1 | 2/2016 | Yoshida et al. | |
| 2016/0138203 | A1 | 5/2016 | Akita | |
| 2018/0142389 | A1 * | 5/2018 | Diaz | D04H 3/05 |
| 2021/0062379 | A1 * | 3/2021 | Diaz | A41D 31/12 |

FOREIGN PATENT DOCUMENTS

| | | | |
|---|---|---|---|
| JP | 2007-054126 | A | 3/2007 |
| JP | 3992687 | B2 | 10/2007 |
| JP | 2012-072537 | A | 4/2012 |
| JP | 2015-101808 | A | 6/2015 |
| JP | 3201984 | U | 1/2016 |
| JP | 2018-048427 | A | 3/2018 |
| TW | 201512484 | A | 4/2015 |
| WO | 2014/157667 | A1 | 10/2014 |
| WO | 2018/056303 | A1 | 3/2018 |

OTHER PUBLICATIONS

International Preliminary Report on Patentability and Written Opinion issued in corresponding International Patent Application No. PCT/JP2019/033795 dated Mar. 2, 2021.

Igaku Youten Sosho 4, Seirigaku, Kinpodo, 2: 266-269 (1987) (see English abstract).

Supplementary European Search Report issued in corresponding European Patent Application No. 19855318.2 dated Sep. 20, 2021.

* cited by examiner

WEFT-KNITTED FABRIC

FIELD

The present invention relates to a weft-knitted fabric. More specifically, the invention relates to a weft-knitted fabric containing elastic fibers, which is suitable for wearing in hot environments.

BACKGROUND

In temperature environments that do not promote sweating, the human body controls body temperature by heat radiation via air convection currents and radiant heat emission, as well as vasodilation. In hot environments where it is difficult for body temperature to be lowered by physiological action, it is known that the human body produces sweat which evaporates to produce a lower body temperature by heat of vaporization (see NPL 1).

For this reason, underwear that is optimally suited for hot environments should exhibit not only stretch properties that make it easy to wear and non-obstructive to movement, but also excellent physical properties including air permeability, moisture absorption, contact cooling and heat dissipation, with air permeability and heat dissipation being especially important for helping to lower body temperature by heat of vaporization. However, knitted fabrics containing polyurethane fibers for the purpose of imparting stretch properties generally tend to have blocked stitches in the knitted fabric when the polyurethane fibers contract, and this lowers the air permeability and heat dissipation, making them less suitable for hot environments.

PTL 1 proposes a knitted fabric suitable for hot environments, but the knitted fabric it describes requires the combined use of cellulose and often also needs the opposite thread to be selected due to differences in dye affinity, and because this limits the types of yarns that can be used it has been difficult to adapt to the diverse needs of consumers. In addition, knitted fabrics that are knitted with a double circular knitting machine tend to have greater thicknesses, which has limited the degree of cooling performance that can be provided for hot environments.

PTL 2 proposes a knitted fabric having improved air permeability when the knitted fabric is wetted by sweat, but this knitted fabric requires the use of special yarn such as water-absorbing self-stretching yarn or non-self-stretching yarn. Moreover, because the loops become deformed by absorption of water, this has led to the problem of dimensional changes when the knitted fabric is worn or after it is dried. Furthermore, when polyurethane fibers are mixed in a knitted fabric having improved air permeability after having absorbed water, the stitches do not adequately stretch out merely by elongation of the swelled non-elastic fibers, and consequently it has been difficult to obtain a knitted fabric having both mixed polyurethane fibers and high air permeability, which means that PTL 2 fails to actually concretely disclose a knitted fabric that uses elastic fibers.

PTL 3 describes a method of obtaining a knitted fabric with a mesh structure by using a circular knitting machine comprising a transfer mechanism, but since knitting of open hole sections produces a layered stitch structure with the stitches at the layered sections having double the thickness, the thickness of the knitted fabric as a whole increases and the air layer in the knitted fabric becomes larger, thus tending to lower heat dissipation, while irregularities in the knitted fabric also increase and lower the contact area with skin, thus making it difficult for heat exchange to take place between the skin and underwear. Moreover, mixing of elastic fibers in such a knitted fabric not only tends to result in collapse of the open hole sections, but also tends to cause the stitches at the loop-transfer layered sections to become thicker due to contraction, thus leading to further lowering of the heat dissipation and consequently causing the knitted fabric to be unsuitable for hot environments.

PTL 4 discloses a single knitted fabric wherein a knit structure and welt structure are formed using a cover ring yarn comprising elastic fibers, in a manner providing suitable clamping force to each part of the body.

CITATION LIST

Patent Literature

[PTL 1] Japanese Unexamined Patent Publication No. 2015-101808

[PTL 2] Japanese Patent Publication No. 3992687

[PTL 3] Utility Model Registration No. 3201984

[PTL 4] Japanese Examined Utility Model Application Publication HEI No. 02-000308

Non Patent Literature

[NPL 1] Igaku Youten Sosho 4, Seirigaku, Kinpodo, 2nd Edition, p269

SUMMARY

Technical Problem

In light of the current state of the related art, it is an object of the present invention to provide a weft-knitted fabric with excellent stretch properties and excellent comfort in hot environments.

Solution to Problem

As a result of diligent experimentation with the aim of solving this problem, the present inventors have found, unexpectedly, that the problem can be solved by the following construction, and the invention has been completed upon this finding.

Specifically, the present invention provides the following.

[1] A weft-knitted fabric comprising non-elastic fibers and elastic fibers, composed of a mesh part in which a course having alternate repetition of a stitch of a welt structure and a stitch of a knit structure is used with continuous knitting of 1-2 courses in the same structural arrangement, and a plain-knit part in which a course having an all-knit structure is used with continuous knitting of 1-3 courses, and the mesh part and plain-knit part are each alternately knitted in the warp direction.

[2] The weft-knitted fabric according to [1] above, wherein the air permeability according to JIS-L-1096—Air Permeability Method A (Frajour type method) is 200 $cc/cm^2/s$ or greater.

[3] The weft-knitted fabric according to [1] or [2] above, wherein the stitch density is 80 to 135 course/inch.

[4] The weft-knitted fabric according to any one of [1] to [3] above, wherein the plain-knit part has continuous knitting of 1-2 courses.

[5] The weft-knitted fabric according to any one of [1] to [4] above, which contains elastic fibers only in the plain-knit part.

[6] The weft-knitted fabric according to any one of [1] to [5] above, wherein the non-elastic fibers are twisted threads.

[7] The weft-knitted fabric according to any one of [1] to [6] above, wherein in the mesh part, a course having alternate repetition of a stitch of a welt structure and a stitch of a knit structure is used with continuous knitting of 2 courses in the same structural arrangement, and in the plain-knit part, a course having an all-knit structure is used with continuous knitting of 2 courses.

[8] The weft-knitted fabric according to any one of [1] to [7] above, wherein the welt structure of the mesh part and the welt structure of the mesh part adjacent to that mesh part across the plain-knit part, are not on the same wale.

[9] The weft-knitted fabric according to any one of [1] to [8] above, wherein the elastic fibers are bare threads that are not covered with non-elastic fibers.

[10] The weft-knitted fabric according to any one of [1] to [9] above, which is a circular knitted fabric.

Advantageous Effects of Invention

The weft-knitted fabric of the invention is a weft-knitted fabric having excellent stretch properties and excellent comfort in hot environments.

DESCRIPTION OF EMBODIMENTS

Embodiments of the invention will now be explained in detail.

Figure 1:
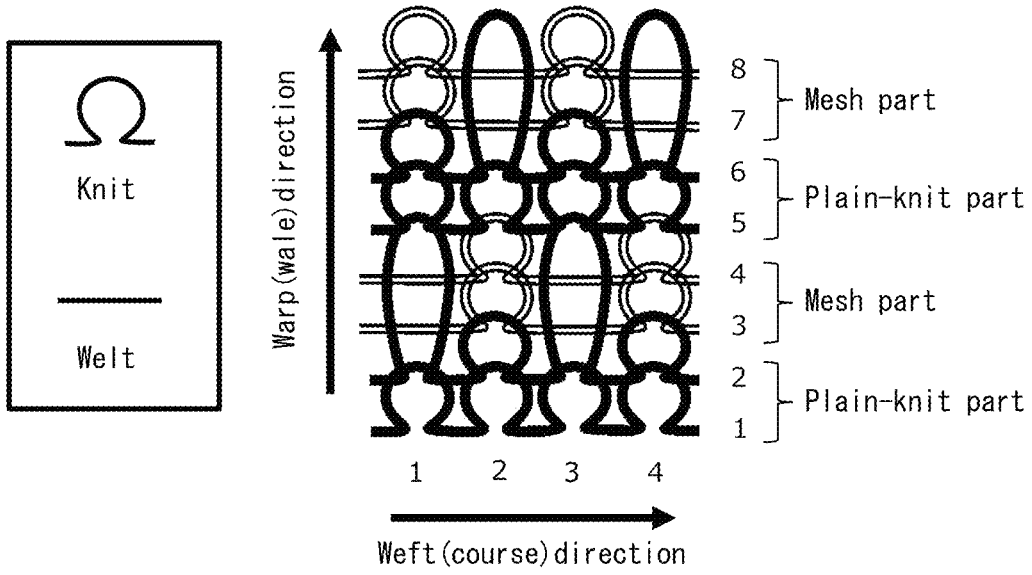
FIG. 1 is an illustration of a knitted texture according to the present embodiment. The course numbers in FIG. 1 are not the same as the supply hole numbers in FIGS. 2 to 10.

The weft-knitted fabric of this embodiment is a weft-knitted fabric comprising non-elastic fibers and elastic fibers. One feature of the weft-knitted fabric of this embodiment is that it comprises non-elastic fibers and elastic fibers, composed of a mesh part in which a course with alternate repetition of a stitch of a welt structure and a stitch of a knit structure is used with continuous knitting of 1-2 courses in the same structural arrangement, and a plain-knit part in which an all-knit structure course is used with continuous knitting of 1-3 courses, and the mesh part and plain-knit part are each alternately knitted in the warp direction (also referred to as the "wale direction"). FIG. 1 is an illustration (knit diagram) of an example of a knitted texture according to this embodiment, comprising a mesh part in which a course with alternate repetition of a stitch of a welt structure and a stitch of a knit structure is used with continuous knitting of 2 courses in the same structural arrangement, and a plain-knit part in which an all-knit structure course is used with continuous knitting of 2 courses, wherein the mesh part and plain-knit part are each alternately knitted in the warp direction.

The knitted fabric of the embodiment is a weft-knitted fabric.

Figure 2:
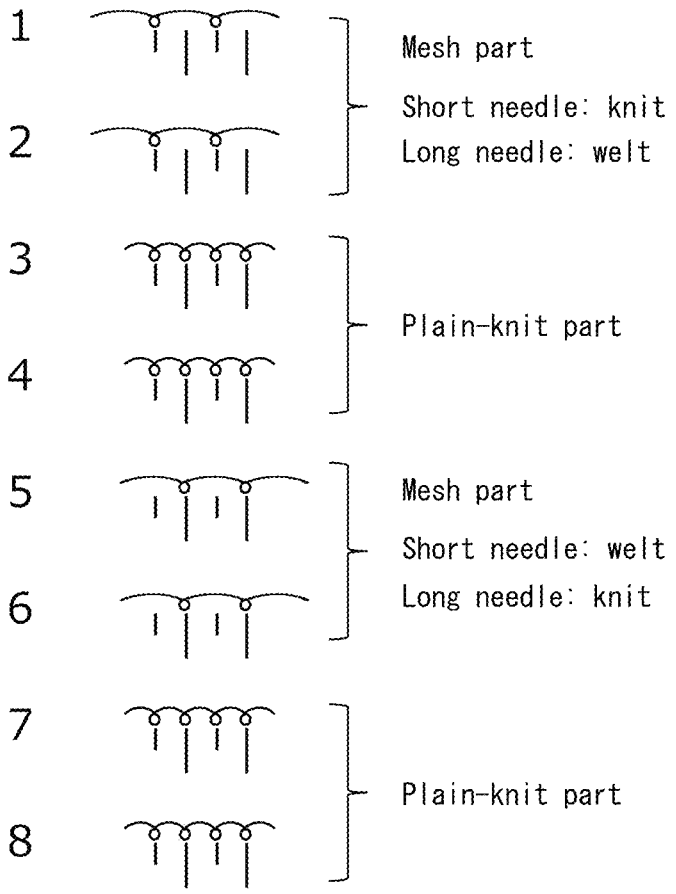
FIG. 2 is a knitting diagram for the knitted texture according to the present embodiment.

As used herein, the phrase "mesh part in which a course having alternate repetition of one stitch each is used with continuous knitting of 1-2 courses in the same structural arrangement" means that, referring to FIG. 2 as an example, using a two-lace circular knitting machine comprising a raising cam and lowering cam corresponding to a long needle and short needle, respectively, knitting is in the warp direction with the same structural arrangement, so that if the 1st wale is the short needle=knit and the 2nd wale is the long needle=welt in the 1st course texture, then the 1st wale is the short needle=knit and the 2nd wale is the long needle=welt in the 2nd course texture as well.

The same also applies for a circular knitting machine such as a 3-lace or 4-lace circular knitting machine, or a circular knitting machine comprising a Jacquard mechanism, the texture design only needing to be such that knits and welts are alternately knitted in the weft direction (also known as the course direction) within the same course, and even with a knit produced by a double circular knitting machine, knitting may be carried out using either the cylinder or dial needle bed to produce the structure described above, with no limitation on the type of circular knitting machine.

If 1-2 courses compose a mesh part in the weft-knitted fabric of this embodiment, then this can prevent excessive sizes of the loops at the open hole sections knitted with a welt structure and can maintain the excellent air permeability of the open hole sections, while also ensuring contact area between the clothing and skin, thus providing a knitted fabric with excellent heat dissipation that promotes heat exchange by contact between the clothing and skin.

A larger number of courses composing the mesh parts will create more subsequent needle loops in the welt structure, thus increasing the sizes of the open hole sections, causing the needle loops to stretch in the warp direction by the amount that the welt structure continues in the warp direction, and consequently creating a large load on the yarn during knock-over and significantly lowering the knittability, but if the welt structure of the mesh parts is continuous for 1-2 courses, then the load during knock-over can be adequately absorbed by the stretchability of the loops themselves, and the knitted fabric will therefore be suited for mass production.

A larger number of courses composing the mesh parts also increases the number of welt structures in the knitted fabric, and since the adjacent courses in the warp direction of the welt structure are not anchored by loops they tend to protrude out on the knitted fabric surface when the knitted fabric is stretched, while the greater number of welt structures also tend to catch onto sharp objects and generate snags, creating a problem when the clothing is worn, but if the welt structure of the mesh parts is continuous for 1-2 courses, then snags will be less likely to form and virtually no such problem will be experienced when the clothing is worn.

When the knitted fabric includes elastic fibers, even if the number of welt structure-containing courses is increased in order to create open hole sections, these open hole sections easily become blocked due to contraction of the elastic fibers, not only usually failing to improve the air permeability but also increasing the thickness of the knitted fabric by loop contraction due to the elastic fibers and increasing the size of the air layer in the knitted fabric, and this tends to lower the heat dissipation and result in a knitted fabric unsuited for hot environments; however, if the welt structures in the mesh parts are continuous for 1-2 courses the open hole sections will be unlikely to become blocked even when they contain elastic fibers, and the resulting knitted fabric will have stretch properties suited for wearing and will be suited for hot environments.

Since the weft-knitted fabric of this embodiment includes not only mesh parts but also plain-knit parts having continuous knitting of 1-3 courses of an all-knit structure, contact area is ensured between the clothing and skin, thus promoting heat exchange by contact between the clothing and skin and resulting in a knitted fabric with excellent heat dissipation.

In a knitted fabric composed only of courses knitted from a knit structure and welt structure (that is, without plain-knit parts), and including elastic fibers, loop contraction of the open hole sections is greater, the knitted fabric as a whole tends to shrink when subjected to dyeing or washing and the open hole sections become more prone to blocking, so that it becomes difficult to obtain air permeability suited for hot environments while also exhibiting the stretch properties of the elastic fibers.

When the plain-knit parts have continuous knitting of 4 or more courses, the number of sections in the clothing where ventilation is not promoted increases, undesirably resulting in an uncomfortable knitted fabric that produces a partly musty sensation when the fabric is worn.

By alternately repeating the mesh part and plain-knit part described above in the weft-knitted fabric of this embodiment, the knitted fabric as a whole not only has less blocking of open hole sections due to shrinkage and less shrinkage during daily use including washing, thus obtaining air permeability suitable for hot environments, but it also has the mesh parts and plain-knit parts evenly distributed throughout the entire knitted fabric, so that portions with poor partial ventilation are not generated when the clothing is worn and ventilation can take place evenly throughout the entire clothing, thus providing clothing that is suited for hot environments.

The number of courses in the mesh parts and the number of courses in the plain-knit parts of the weft-knitted fabric of this embodiment may differ, with appropriate adjustment so that the number of wales in the mesh parts is in the range of 1-2 courses and the number of wales in the plain-knit parts is in the range of 1-3 courses.

In the weft-knitted fabric of this embodiment, the air permeability, according to JIS-L-1096—Air Permeability Method A (Frajour type method), is preferably 160 cc/cm$^2$/s or greater, more preferably 200 cc/cm$^2$/s or greater and even more preferably 250 cc/cm$^2$/s. If the air permeability is 160 cc/cm$^2$/s or greater, it will be possible to ventilate heat-laden air in the clothing even when the internal environment of the clothing is resistant to air circulation, or even when body movements or changes in posture cause slight movement of air, thus making the knitted fabric even more suited for hot environments.

It is said that when underwear is worn, the underwear stretches by a maximum of about 10% due to posture changes or movement, and therefore by evaluating the state of the knitted fabric at 10% elongation it is possible to accurately evaluate its air permeability when the knitted fabric will be used as underwear.

In the weft-knitted fabric of this embodiment, the air permeability of a knitted fabric that has been stretched 10% in either the warp direction or the weft direction, as evaluated according to JIS-L-1096—Air Permeability Method A (Frajour type method), is preferably 300 cc/cm$^2$/s or greater and more preferably 340 cc/cm$^2$/s or greater. If the value is 300 cc/cm$^2$/s or greater it will be possible to further ventilate heat-laden air in the clothing even when body movements or changes in posture cause slight movement of air, thus making the knitted fabric even more suited for hot environments, by allowing it to efficiently ventilate heat-laden air in clothing during movement. The method for measuring the air permeability at 10% elongation is explained below under Examples.

The means for adjusting the air permeability to the range specified above is not particularly restricted and common technologies may be employed, such as increasing the loop length for the non-elastic fibers to create larger loops, lowering the draft ratio for elastic fibers to inhibit stitch contraction, or heat setting the knitted fabric so that the stitch density is 80 course/inch to 135 course/inch (2.54 cm).

If the number of courses forming the plain-knit parts are 1-2 courses each in the weft-knitted fabric of this embodiment, then the mesh parts and plain-knit parts can be essentially evenly distributed and shrinkage of the knitted fabric as a whole at the plain-knit parts composed of an all-knit structure can be satisfactorily inhibited, thus allowing stretch properties suited for wearing to be provided, while also ensuring air permeability that is more suited for hot environments.

If the number of courses forming the mesh parts is 2 courses and the number of courses forming the plain-knit parts is also 2 courses in the weft-knitted fabric of this embodiment, then it will be possible to ensure sufficient air permeability while also ensuring the maximum possible contact area for heat exchange between the skin and underwear, so that the knitted fabric will be highly suited for hot environments.

Non-elastic fibers in the weft-knitted fabric of the embodiment are fibers having a maximum ductility of lower than 100%. Natural fibers or synthetic fibers may be used as the non-elastic fibers, but there is no particular limitation to these.

Natural fibers include cotton, hemp, silk and wool. Synthetic fibers include polyester fibers such as polyethylene terephthalate and polytrimethylene terephthalate, polyamide fibers such as nylon 6 and nylon 66 and polyolefin fibers such as polyethylene and polypropylene, and their bright threads, semi-dull threads or full dull threads may be selected, while the cross-sectional shapes of the fibers may be any cross-sectional shapes such as round, elliptical, W-shaped, cocoon-shaped or hollow fiber forms, and the form of the fibers is not particularly restricted and may be raw yarn or textured yarn such as false-twisted yarn.

Regenerated (refined) cellulose fibers such as rayon, cupro or lyocell may also be used, and the cellulose fibers may be in the form of single threads as gray yarn or twisted threads, or they may be in the form of composite yarns with the synthetic fibers mentioned below. The form of the composite yarn is not particularly restricted, and the compositing method may be selected as composite interlacing or combined twisting, for example, depending on the purpose of use. The size of composite yarn of cellulose fiber and synthetic fibers is preferably a size of 19 to 90 dtex, which will allow a knitted fabric to be obtained with excellent bending softness, and a thin form with an excellent wearable feel in hot environments.

The elastic fibers in the weft-knitted fabric of this embodiment differ from the synthetic fibers mentioned above, and are fibers with a maximum ductility of 100% or greater. The elastic fiber polymer and spinning process are not particularly restricted, and polyurethane-based or polyether ester-based elastic fibers may be used, while dry spinning or melt spinning may be employed in the case of polyurethane-based elastic fibers, for example. Elastic fibers preferably do not impair the stretchability near 180° C., as the normal treatment temperature in preset steps for dyeing. Elastic fibers with functionality such as high settability, a deodorant property or antibacterial properties may also be used, by including special polymers or inorganic powder in the elastic fibers. The size of the elastic fibers is preferably 10 to 80 dtex, and from the viewpoint of easy knitted fabric production it is more preferably 15 to 60 dtex.

The weft-knitted fabric of the embodiment preferably has a texture comprising elastic fibers only in the plain-knit parts. By knitting elastic fibers only in the plain-knit parts it will be possible to achieve a higher level for the stretch properties of the elastic fibers and the air permeability of the mesh parts, to provide a knitted fabric more suited for hot environments. The method for knitting the elastic fibers in the plain-knit parts is not particularly restricted, and it may be plating or knitting using composite yarn.

The elastic fibers used in the weft-knitted fabric of the embodiment may be bare threads that are not covered by non-elastic fibers, or covered threads which are bare threads covered by non-elastic fibers, but it is preferred to use bare threads from the viewpoint of providing a knitted fabric that is particularly suited for wearing in hot environments. If the elastic fibers are knitted by plating or alignment, then usually the knitted structure will have the elastic fibers arranged on the skin side, and selection of the elastic fibers will affect how sweat is treated. When composite yarn such as covered thread or aligned thread is used as the elastic fibers then the high water-absorbing non-elastic fibers will be in contact with the skin, a condition which is effective for treating low levels of sweat. For treatment of high levels of sweat, on the other hand, it is preferred to use bare threads as the elastic fibers since moisture will be less likely to remain around the elastic fibers and the knitted fabric will dry more rapidly, tending to produce greater comfort during wear.

Figure 3:
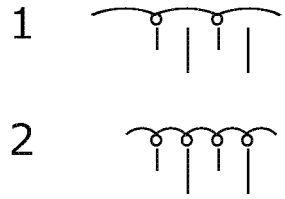
FIG. 3 is one example of a knitting diagram for a preferred knitted texture of the embodiment.
Figure 6:
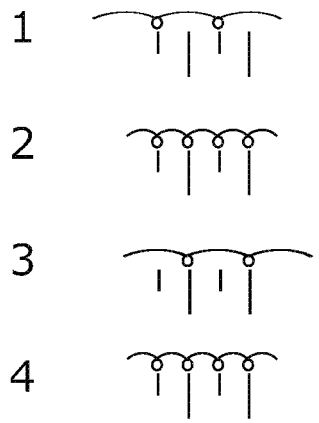
FIG. 6 is one example of a knitting diagram for a preferred knitted texture of the embodiment.

Using bare threads as the elastic fibers will also produce narrower fiber sizes, thus making the stitches less prone to collapse and increasing the air permeability, so that the resulting knitted fabric will be especially suitable for wearing in hot environments. This effect is particularly notable when the mesh parts have covered threads as elastic fibers with a 1-course texture, as illustrated in FIG. 3 and FIG. 6.

The non-elastic fibers of the embodiment are preferably twisted threads. Since with twisted threads the air layer in the threads is reduced and heat dissipation of the knitted fabric as a whole is improved, the resulting knitted fabric is more suited for wearing in hot environments. Using twisted threads also prevents snags, providing a knitted fabric even more suited for practical use.

The number of twists in the twisted threads is not particularly restricted and may be appropriately selected depending on the desired knitted fabric feel and heat dissipation performance, but from the general viewpoint of feel and heat dissipation the number of twists is preferably 100 T/m to 2000 T/m and more preferably 100 T/m to 1000 T/m.

In the weft-knitted fabric of this embodiment, as shown in FIGS. 1 and 2 (the course numbers in FIG. 1 are not the same as the supply hole numbers in FIGS. 2 to 10), the welt structure of any given mesh part and the welt structure of the mesh part adjacent to that mesh part across from a plain-knit part more preferably have structures that are not on the same wale. With such structures, the welt structure of the mesh part will not be knitted continuously in the same wale as the welt structure of the mesh part adjacent to the mesh part across the plain-knit part, but will be shifted in the weft direction across each plain-knit part, thus allowing the irregularities to be uniform throughout the entire knitted fabric, increasing the contact area when the knitted fabric contacts skin and promoting heat exchange between the skin and underwear, to provide a knitted fabric more suited for wearing in hot environments.

The loop length during knitting of a knitted fabric generally differs significantly depending on the gauge of the knitting machine, and for the weft-knitted fabric of this embodiment as well, the loop length is not particularly restricted and may be selected as appropriate depending on the knitting machine gauge or the desired feel. For this embodiment, the length of each thread per 100 wales in a single course of the disassembled knitted fabric is considered to be the loop length, with the units expressed as mm/100 w.

In the weft-knitted fabric of this embodiment, the loop length is preferably changed between the mesh parts and plain-knit parts, the loop length ratio represented by the following formula (1):

Loop length ratio=Mesh part loop length/plain-knit part loop length formula (1) being preferably in the range of 0.5 to 0.9 and more preferably 0.6 to 0.8. If the loop length ratio is 0.5 or greater it will be possible to prevent the loops of the mesh parts from being excessively small with respect to the plain-knit parts, thus helping to exhibit high air permeability and to provide stretch properties. In a knitted fabric comprising elastic fibers and non-elastic fibers, the contractive force of the non-elastic fibers is lower than the contractive force of the elastic fibers, and therefore sinker loops at the welt structure sections that have been knitted with non-elastic fibers tend to protrude out from the knitted fabric surface, potentially lowering the resistance to snagging, but a loop length ratio of 0.9 or lower can prevent the loop lengths of the mesh parts from being excessively large and can help prevent welt structures from protruding out from the knitted fabric surface, thus allowing snag formation to be prevented.

In the weft-knitted fabric of this embodiment, the loop lengths of the elastic fibers during plating of non-elastic fibers and elastic fibers in each course with respect to the loop lengths of the simultaneously knitted non-elastic fibers, i.e. the loop length ratio represented by the following formula (2):

Loop length ratio=Elastic fiber loop length/non-elastic fiber loop length formula (2) is preferably 0.25 to 0.50, and if knitting is done while applying suitable tension to the elastic fibers it is possible to increase the elongation recovery factor of the knitted fabric and to impart a degree of kickback to the knitted fabric that is optimally suited for wearing.

In the weft-knitted fabric of this embodiment, the elongation recovery rate is preferably 80% or higher in both the warp and weft directions. An elongation recovery rate of 80% or higher will provide a knitted fabric that is suitable for use as underwear, without losing its form when it is being put on, or by movement while it is worn, or by washing. In order to obtain an elongation recovery rate of 80% or higher while maintaining air permeability of 200 $cc/cm^2/s$ or greater, preferably the loop length ratio of the elastic fiber during plating is 0.25 to 0.50, or the knitted fabric is heat set to between 80 course/inch and 135 course/inch (2.54 cm), or dyeing is carried out with the softener added to the bath at 0.1% owf to 2.0% owf during dyeing.

The expansive force at 40% elongation for the weft-knitted fabric of the embodiment is preferably 70 cN or lower and more preferably 65 cN or lower in both the warp and weft directions. If the expansive force at 40% elongation is 70 cN or lower in both the warp and weft directions of the knitted fabric, then it will be possible to obtain a soft-stretch knitted fabric which can be comfortably worn without a feeling of tightness even when the knitted fabric has been stretched while being worn, and which has recoverability allowing it to be fitted without excess, thereby avoiding impairment of the outer appearance.

In the weft-knitted fabric of this embodiment, the amount of heat radiation on the needle loop side of the weft-knitted fabric (hereunder also referred to as dry heat loss, or "DHL"), is preferably 9.0 $W/m^2 \cdot {}^\circ C$. or greater. If the DHL is 9.0 $W/m^2 \cdot {}^\circ C$. or greater, the resulting knitted fabric will be unlikely to feel hot even after being continuously worn. The DHL on the needle loop side is preferably 10.0 $W/m^2 \cdot {}^\circ C$. or greater.

In the weft-knitted fabric of the embodiment, the stitch density in the warp direction is preferably between 80 course/inch and 135 course/inch (2.54 cm), and more preferably between 90 course/inch and 120 course/inch, from the viewpoint of obtaining ductility that provides an actual feeling of contact coolness and makes it easier to put on and remove the fabric. If the stitch density is 135 course/inch or less, then it will be easy to obtain sufficient ductility for wearing, thickness can be avoided and air permeability can be obtained, so that the resulting knitted fabric will be suitable for wearing in hot environments. If it is 80 course/inch or greater, on the other hand, a sufficient contact cooling feel can be obtained.

The basis weight of the weft-knitted fabric of this embodiment is preferably 70 $g/m^2$ to 180 $g/m^2$ and more preferably 70 $g/m^2$ to 140 $g/m^2$. If the basis weight is 70 $g/m^2$ or greater, the rupture strength will be improved and the knitted fabric will have no problems for actual wearing. If the basis weight is 180 $g/m^2$ or lower, on the other hand, excessive thickening of the knitted fabric will be avoided, and the knitted fabric will therefore be resistant to mustiness and will have a lower heat capacity making it less likely to store heat and giving it increased heat dissipation, so that the knitted fabric will be suitable for wearing in hot environments.

The thickness of the weft-knitted fabric of this embodiment is preferably 0.30 mm to 0.70 mm and more preferably 0.40 mm to 0.60 mm. If the thickness is 0.30 mm or greater the see-through property and hardness when worn will not be problematic, while if it is 0.70 mm or smaller the basis weight will not be excessively high, an air layer will be less likely to form between the skin and knitted fabric, and sufficient heat dissipation can be obtained.

It is preferred to use a circular knitting machine in order to obtain the weft-knitted fabric for this embodiment, with no particular restriction on the circular knitting machine used, and the gauge of the knitting machine also being freely selectable, although a knitting machine with a gauge of 24 to 60 is preferably used. If the gauge is 24 or higher, the needle size will be sufficiently small to allow knitting of a knitted fabric with small stitches using fine yarn, and the resulting knitted fabric will have a smooth surface with a pleasant feel on the skin, as well as low thickness with a satisfactory aesthetic appearance and excellent heat dissipation. If the gauge is 60 or lower, it will be possible to prevent the loop size from being too small, and suitable stretch properties can be imparted without creating a feeling of stress when worn.

The weft-knitted fabric of this embodiment may also be dyed. The method of producing a dye finish may employ common dye finishing steps, under dyeing conditions suited for the fiber materials used, and the dyeing machine used may be a jet dyeing machine, winch dyeing machine or paddle dyeing machine. Finishing agents used to improve the water absorption and softness may also be used. Softeners that are used may be silicon-based, urethane-based or ester-based softeners, at concentrations appropriately selected depending on the desired feel for the knitted fabric, with a range of 0.1% owf to 2.0% owf satisfactorily reducing snags and lowering friction between stitches, thus allowing better soft-stretch properties and recoverability to be exhibited.

EXAMPLES

The invention will now be explained in greater detail by examples. It is naturally understood, however, that the invention is not limited to these examples.

The following measurement methods were used for the property values in the Examples. The knitted fabrics used for measurement were knitted fabrics cut out from clothing, but the present invention also encompasses knitted fabrics that are not part of clothing.

(1) Basis Weight ($g/m^2$)

This was measured according to Mass Per Unit Area, Method A (JIS), under the standard conditions of JIS-L-1096.

(2) Stitch Density

Number of wales: The number of needle loops per 1-inch in the weft direction (course direction) of the knitted fabric is measured. For knitted fabrics containing mesh parts, the number of needle loops may differ for each course depending on the knitted fabric texture, in which case the number of wales is the number of needle loops in the course with the greatest number of needle loops, and the units used are wale/inch.

Number of courses: The number of needle loops per 1-inch in the warp direction (wale direction) of the knitted fabric is measured. For knitted fabrics containing mesh parts, the number of needle loops may differ for each wale depending on the knitted fabric texture, in which case the number of courses is the number of needle loops in the wale with the greatest number of needle loops, and the units used are course/inch.

(3) Thickness (Mm)

Measurement is performed at 3 arbitrary locations of the knitted fabric using a knitted fabric thickness gauge by Peacock Co., and the average of the 3 locations is calculated.

(4) Air Permeability (Unstretched, $cc/cm^2/s$)

The test method and number of sheets measured all conform to JIS-L-1096, Air Permeability Method A (Frajour type method).

(5) Air Permeability at 10% Elongation for Warp and Weft ($cc/cm^2/s$)

A test piece with a size of 250 mm×250 mm is sampled, and a 200 m×200 mm frame border is drawn in the sample. The 200 mm×200 mm frame border is set in a pin frame while stretched to 220 mm×220 mm, and the air permeability is measured with a Frajour-type air permeability tester. The air permeability scale reading method, the test piece sampling site and the number of measurements conform to JIS-L-1096, Air Permeability Method A (Frajour type method).

(6) Maximum Instantaneous Heat Transfer Quantity (Q-Max, $W/m^{2}\cdot°$ C.)

A knitted fabric cut to 8 cm×8 cm is humidified in an environment of 20° C., 65%, and using a KES-F7-II by Kato Tech Corp., the hot plate heated to environmental temperature+10° C. is placed on the measuring surface of the knitted fabric, measurement is conducted, and the maximum heat transfer quantity ($W/m^{2}$. ° C.) per 1 $m^{2}$ knitted fabric area with a temperature difference of 1° C. is determined by the following formula:

Maximum heat transfer quantity ($W/m^{2}\cdot°$ C.)=Measured value ($W/cm^{2}\cdot 10°$ C.)×(10,000/10).

(7) Heat Radiation Quantity (DHL, $W/m^{2}\cdot°$ C.)

A knitted fabric cut to 15 cm×15 cm is humidified in an environment of 20° C., 65%, and using a KES-F7-II by Kato Tech Corp., heat retention measurement is carried out by the dry contact method with a hot plate temperature of 30° C. and an airflow rate of 0.3 m/sec, and the heat radiation quantity per 1 $m^{2}$ knitted fabric area with a temperature difference of 1° C. is calculated by the following formula:

Heat radiation quantity ($W/m^{2}\cdot°$ C.)=Measured value ($W/100\ cm^{2}\cdot 10°$ C.)×(100/10)

The knitted fabric is set with the hot plate and knitted fabric measuring surface facing each other.

(8) Snags

The test method, number of measurements and grade assessment all conform to JIS-L1058-D-4 (Textile and knitted fabric snag test method).

(9) Stretching Force at 40% Elongation (Load, cN)

Using a tensile tester, a knitted fabric cut out to 2.5 cm width×15 cm length is gripped at both ends of the knitted fabric at 2.5 cm widths. Gripping is with an interval of 10 cm between gripping parts, and elongation and recovery are repeated 3 times at a pull rate of 300 mm/min, with the outward stress and return stress being measured up to an elongation percentage of 80% to draw an elongation recovery curve, and the stress when stretched to an elongation percentage of 40% at the third elongation being recorded as the stretching force.

(10) Loop Length

Disassembly of knitted fabric: The knitted fabric is cut in one course to a range of 100 wales, the knitted fabric is loosened and the non-elastic fibers and elastic fibers are removed. The measuring environment is a standard environment of 20° C., 50%.

Loop length of non-elastic fibers: One end of a non-elastic fiber obtained from the disassembled knitted fabric is anchored and the fabric is suspended, and then a predetermined load suited for the type of yarn as described below is attached to the other end and the length after 30 seconds is measured. The units are expressed in mm/100 w. The loop length is also measured by this method for composite yarns comprising non-elastic fibers and elastic fibers.

<Load According to Yarn Type>

For synthetic fiber elastic bulk yarns and composite yarns of non-elastic fibers and elastic fibers: 8.82 mN/dtex For other non-elastic fibers: 2.94 mN/dtex Loop length of elastic fibers: One end of an elastic fiber obtained from the disassembled knitted fabric is anchored and the fabric is suspended, and upon confirming that the elastic fiber is essentially straight linear, the length in that state is measured. The units are expressed in mm/100 w.

(11) Elongation Recovery Rate

The residual elongation (%) after elongation recovery 3 times is read off from the elongation recovery curve drawn in (9) above, and calculation is performed by the following formula:

Elongation recovery rate %)={(80−residual elongation+80}×100.

(12) Wearability and Comfort

A short sleeve inner wear piece for the upper body was sewed using a knitted fabric obtained in each of the Examples and Comparative Examples, and was worn by a monitor, with a white shirt and slacks also being worn after putting on short sleeve inner wear. After sitting stationary on a chair for 5 minutes after putting on the clothing, in an environment of 30° C., 70% RH to simulate commuting to work in a mid-summer hot environment, a treadmill was used for 20 minutes of walking at a speed of 4.5 km/h. The wearability and comfort from putting on the inner wear until the walking period was completed was subjectively evaluated according to the three properties of: [1: wearability], [2: comfort immediately after putting on] and [3: comfort while worn], based on the 5-level evaluation scale shown below. The test was conducted by 10 monitors, and the average value for each property was recorded as the evaluation result. The average value was rounded up to two decimal places and the first decimal place was calculated. An average of 4.0 or greater was judged to be excellent wearability or comfort. Comfort during wear is particularly important in hot environments and is considered a priority over the wearability and comfort of clothing after it has been put on, though these are also important.

[Property 1: Wearability]

5: Easy to put on, no feeling of tightness. Stretchable, underwear followed body movement and white shirt was easy to put on.

4: Easy to put on, no feeling of tightness.

3: No problem when put on, but slight feeling of tightness and hampered movement.

2: Low knitted fabric ductility, difficult to put on. Slightly tight when worn.

1: Low knitted fabric ductility, difficult to put on. Tight when worn, body movement difficult.

[Property 2: Comfort Immediately after being Put On]

5: Coolness felt immediately after putting on, smooth knitted fabric surface, comfortable when worn.

4: Coolness felt immediately after putting on.

3: Slight coolness felt immediately after putting on.

2: No coolness felt immediately after putting on.

1: No coolness felt immediately after putting on, rough knitted fabric surface and unpleasant itchy feel immediately after putting on.

[Property 3: Comfort when Worn]

5: Heat was not trapped inside inner wear, minimal mustiness even when sweating during movement. Also no friction between the skin and inner wear during movement, with a comfortable feel when worn.

4: Heat was not trapped inside inner wear, minimal mustiness even when sweating during movement.

3: Heat tended to be trapped inside inner wear.

2: Heat tended to be trapped inside inner wear. Mustiness and discomfort felt immediately after initial movement.

1: Heat trapped inside inner wear, creating mustiness and high discomfort. Also, friction between skin and inner wear during movement caused pain when worn.

(13) Quick-Drying Property (Residual Moisture after 60 Minutes)

A knitted fabric cut to 15 cm×15 cm is humidified in an environment of 20° C.×65%. In the same environment, the weight ($W_c$) of a measuring cup (8 cm diameter, 10 cm height, cylindrical polypropylene) is measured, the humidified fabric is placed in the cup, and the weight ($W_{c+t}$) of the cup and fabric is measured. A micropipetter is then used to drop 300 μl of purified water onto the fabric, and the weight ($W_{c+t+w}$) is immediately recorded. The weight ($W_w$) of the dropped water is calculated by the following formula:

$$W_w = W_{c+t+w} - W_{c+t}$$

Next, the fabric is allowed to stand for 60 minutes while in the cup to dry the fabric, after which the weight ($W_{c+t}'$) of the cup and fabric is measured and the residual moisture after 60 minutes is calculated by the following formula:

$$\text{Residual moisture after 60 minutes (\%)} = (W_{c+t}' - W_{c+t})/W_w \times 100$$

Lower residual moisture after 60 minutes corresponds to a knitted fabric with a more excellent quick-drying property, suited for hot environments.

Example 1

A 40-gauge single circular knitting machine was used for aligned knitting with nylon (denoted as "Ny" in Tables 1 to 3) 44 dtex/48 filament untwisted yarn as the base thread and 22 dtex polyurethane elastic fibers (trade name: Roica by Asahi Kasei Corp.) (denoted as "Pu" in Tables 1 to 3), in mesh parts comprising a knit structure and welt structure. The plain-knit parts composed of only a knit structure were knitted with the same yarn usage, to form a knitted fabric according to the knitting diagram shown in FIG. 3. The knitted fabric was relaxed and scoured with a continuous scouring machine, and then preset for 1 minute at 190° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suited for use in clothing to be worn in hot environments.

Example 2

A 36-gauge single circular knitting machine was used for aligned knitting with nylon 44 dtex/48 filament untwisted yarn as the base thread and 19 dtex polyurethane elastic fibers (trade name: Roica by Asahi Kasei Corp.), in mesh parts comprising a knit structure and welt structure. The plain-knit parts composed of only a knit structure were knitted with the same yarn usage, to form a knitted fabric according to the knitting diagram shown in FIG. 4. The knitted fabric was relaxed and scoured with a continuous scouring machine, and then preset for 1 minute at 185° C. Dyeing was carried out with addition of the softener NICEPOLE PRN (product of Nicca Chemical Co., Ltd.) at 0.5% owf during dyeing, and then finish setting was carried out under conditions of 185° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 3

A 36-gauge single circular knitting machine was used for aligned knitting with polyester (denoted as "Es" in Tables 1 to 3) 33 dtex/36 filament untwisted yarn as the base thread and 19 dtex polyurethane elastic fibers (trade name: Roica by Asahi Kasei Corp.), in mesh parts comprising a knit structure and welt structure. The plain-knit parts composed of only a knit structure were knitted with the same yarn usage, to form a knitted fabric according to the knitting diagram shown in FIG. 5. The knitted fabric was relaxed and scoured with a continuous scouring machine, and then preset for 1 minute at 180° C. After dyeing, padding was carried out with addition of the softener NICEPOLE PRN (product of Nicca Chemical Co., Ltd.) at 2.0% owf, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 4

A 36-gauge single circular knitting machine was used for knitting with nylon 44 dtex/48 filament untwisted yarn in mesh parts comprising a knit structure and welt structure. Plain-knit parts composed of a knit structure alone were knitted by aligned knitting with nylon 44 dtex/48 filament untwisted yarn as the base thread and 19 dtex polyurethane elastic fibers (trade name: Roica by Asahi Kasei Corp.), to form a knitted fabric according to the knitting diagram of FIG. 3. The knitted fabric was relaxed and scoured with a continuous scouring machine, and then preset for 1 minute at 190° C. Dyeing was carried out with addition of Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 5

A 36-gauge single circular knitting machine was used for knitting with nylon 44 dtex/48 filament yarn twisted with 1200 T/m for mesh parts comprising a knit structure and welt structure. Plain-knit parts composed of a knit structure alone were knitted by aligned knitting with nylon 44 dtex/48 filament yarn twisted with 1200 T/m, as the base thread, and 19 dtex polyurethane elastic fibers (trade name: Roica by Asahi Kasei Corp.), to form a knitted fabric according to the knitting diagram of FIG. 6. The knitted fabric was relaxed and scoured with a continuous scouring machine, and then preset for 1 minute at 190° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 6

A 36-gauge single circular knitting machine was used for knitting of a 1st course with nylon 44 dtex/48 filament yarn twisted with 100 T/m, and knitting of a 2nd course with composite yarn comprising nylon 13 dtex/7 filaments and cupro (denoted as Cu in Tables 1 to 3) 33 dtex/24 filaments, in mesh parts comprising a knit structure and welt structure. In plain-knit parts composed of a knit structure alone, knitting for a 1st course was carried out by aligned knitting with nylon 44 dtex/48 filaments twisted with 100 T/m, as the base thread, and 19 dtex polyurethane elastic fibers (trade name: Roica by Asahi Kasei Corp.), and knitting for a 2nd course was carried out by aligned knitting with composite yarn comprising nylon 13 dtex/7 filaments and cupro 33 dtex/24 filaments, and 19 dtex polyurethane elastic fibers (trade name: Roica by Asahi Kasei Corp.), to form a knitted fabric according to the knitting diagram of FIG. 7. The knitted fabric was relaxed and scoured with a continuous scouring machine, and then preset for 1 minute at 190° C. Dyeing was carried out with addition of Nikka Silicon AMZ (product of Nicca Chemical Co., Ltd.) at 0.1% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 7

A 32-gauge single circular knitting machine was used for knitting with nylon 44 dtex/48 filament yarn twisted with 1000 T/m for mesh parts comprising a knit structure and welt structure. Plain-knit parts composed of a knit structure alone were knitted by aligned knitting with nylon 44 dtex/48 filament yarn twisted with 1000 T/m, and 19 dtex polyurethane elastic fibers (trade name: Roica by Asahi Kasei Corp.), to form a knitted fabric according to the knitting diagram of FIG. 7. The knitted fabric was relaxed and scoured with a continuous scouring machine, and then preset for 1 minute at 190° C. A knitted fabric obtained by finish setting carried out under conditions of 185° C., 1 minute without using a softener, was used for sewing of a short sleeve inner wear piece, which was then evaluated. The evaluation results are shown in Tables 1 to 3 below. The obtained knitted fabric had excellent air permeability and heat dissipation, and was suitable for use in clothing to be worn in hot environments.

Example 8

A 36-gauge single circular knitting machine was used for knitting with nylon 44 dtex/48 filament yarn twisted with 500 T/m for mesh parts comprising a knit structure and welt structure. Plain-knit parts composed of a knit structure alone were knitted by aligned knitting with nylon 44 dtex/48 filament yarn twisted with 500 T/m, and 19 dtex polyurethane elastic fibers (trade name: Roica by Asahi Kasei Corp.), to form a knitted fabric according to the knitting diagram of FIG. 5. The knitted fabric was relaxed and scoured with a continuous scouring machine, and then preset for 1 minute at 190° C. Dyeing was carried out with addition of NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 9

A 28-gauge single circular knitting machine was used for knitting in mesh parts comprising a knit structure and welt structure, with 33 dtex polyurethane elastic fibers (trade name: Roica by Asahi Kasei Corp.) as the core yarn stretched at a draft of 2.8, and using single covering yarn having nylon 44 dtex/36 filaments wrapped at 500 T/m. Plain-knit parts composed of only a knit structure were knitted with the same yarn usage, to form a knitted fabric according to the knitting diagram of FIG. 5. The knitted fabric was relaxed and scoured with a continuous scouring machine, and then preset for 1 minute at 180° C. After dyeing, padding was carried out with addition of the softener NICEPOLE PRN (product of Nicca Chemical Co., Ltd.) at 2.0% owf, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 10

A 36-gauge single circular knitting machine was used for knitting with nylon 44 dtex/48 filament yarn twisted with 1200 T/m for mesh parts comprising a knit structure and welt structure. Plain-knit parts composed of a knit structure alone were knitted by aligned knitting with nylon 44 dtex/48 filament yarn twisted with 1200 T/m, as the base thread, and 19 dtex polyurethane elastic fibers (trade name: Roica by Asahi Kasei Corp.), to form a knitted fabric according to the knitting diagram of FIG. 6. The knitted fabric was relaxed and scoured with a continuous scouring machine, and then preset for 1 minute at 190° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had excellent air permeability and heat dissipation, and was suitable for use in clothing to be worn in hot environments.

Example 11

A 36-gauge single circular knitting machine was used for knitting with nylon 44 dtex/48 filament yarn twisted with 1200 T/m for mesh parts comprising a knit structure and welt structure. Plain-knit parts composed of a knit structure alone were knitted with 33 dtex polyurethane elastic fibers (trade name: Roica by Asahi Kasei Corp.) as the core yarn stretched at a draft of 2.8, and using single covering yarn having nylon 22 dtex/13 filaments wrapped at 500 T/m, to form a knitted fabric according to the knitting diagram of FIG. 6. The knitted fabric was relaxed and scoured with a continuous scouring machine, and then preset for 1 minute at 180° C. After dyeing, padding was carried out with addition of the softener NICEPOLE PRN (product of Nicca Chemical Co., Ltd.) at 2.0% owf, and then finish setting was carried out under conditions of 170° C., 1 minute and the obtained knitted fabric was used for sewing of a short sleeve inner wear piece, which was evaluated. The evaluation results are shown in Tables 1 to 3 below.

Comparative Example 1

A 40-gauge single circular knitting machine was used for aligned knitting with nylon 33 dtex/26 filament untwisted yarn as the base thread and 19 dtex polyurethane elastic fibers (trade name: Roica by Asahi Kasei Corp.), to form a plain stitch knitted fabric according to the knitting diagram of FIG. 8, having a completely knitted structure. The knitted fabric was relaxed and scoured with a continuous scouring machine, and then preset for 1 minute at 190° C. Dyeing was carried out with addition of NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had insufficient air permeability and inadequate ventilation within the clothing during wear, and therefore the knitted fabric was unsuited for hot environments in which heat tends to be trapped inside clothing.

Comparative Example 2

A 36-gauge single circular knitting machine was used for aligned knitting with nylon 44 dtex/48 filament untwisted yarn as the base thread and 19 dtex polyurethane elastic fibers (trade name: Roica by Asahi Kasei Corp.), in mesh parts comprising a knit structure and welt structure. Plain-knit parts composed of only a knit structure were knitted with the same yarn usage, to form a knitted fabric according to the knitting diagram of FIG. 9. The knitted fabric was relaxed and scoured with a continuous scouring machine, and then preset for 1 minute at 190° C. Dyeing was carried out with addition of Nikka Silicon AMZ (product of Nicca Chemical Co., Ltd.) at 0.1% owf during dyeing, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had insufficient air permeability and inadequate ventilation within the clothing during wear, and therefore the knitted fabric was unsuited for hot environments in which heat tends to be trapped inside clothing.

Comparative Example 3

A 32-gauge single circular knitting machine was used for knitting of a knitted fabric composed of only mesh parts comprising a knit structure and welt structure. Knitting for the odd courses was carried out by aligned knitting with nylon 44 dtex/48 filament yarn twisted with 500 T/m, as the base thread, and 19 dtex polyurethane elastic fibers (trade name: Roica by Asahi Kasei Corp.), and knitting for the even courses was carried out by aligned knitting with cupro 33 dtex/24 filaments as the base thread, and 19 dtex polyurethane elastic fibers (trade name: Roica by Asahi Kasei Corp.), according to the knitting diagram of FIG. 10. The knitted fabric was relaxed and scoured with a continuous scouring machine, and then preset for 1 minute at 190° C. After dyeing, padding was carried out with addition of the softener NICEPOLE PRN (product of Nicca Chemical Co., Ltd.) at 0.5% owf, and then finish setting was carried out under conditions of 170° C., 1 minute and the obtained knitted fabric was used for sewing of a short sleeve inner wear piece, which was evaluated. The evaluation results are shown in Tables 1 to 3 below. The obtained knitted fabric had insufficient air permeability and ventilation was inadequate within the clothing during wear, and therefore the knitted fabric was unsuited for hot environments in which heat tends to be trapped inside clothing.

Comparative Example 4

Figure 8:
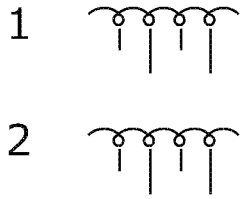
FIG. 8 is a knitting diagram for the knitted textures of Comparative Examples 1, 4 and 5.
Figure 9:
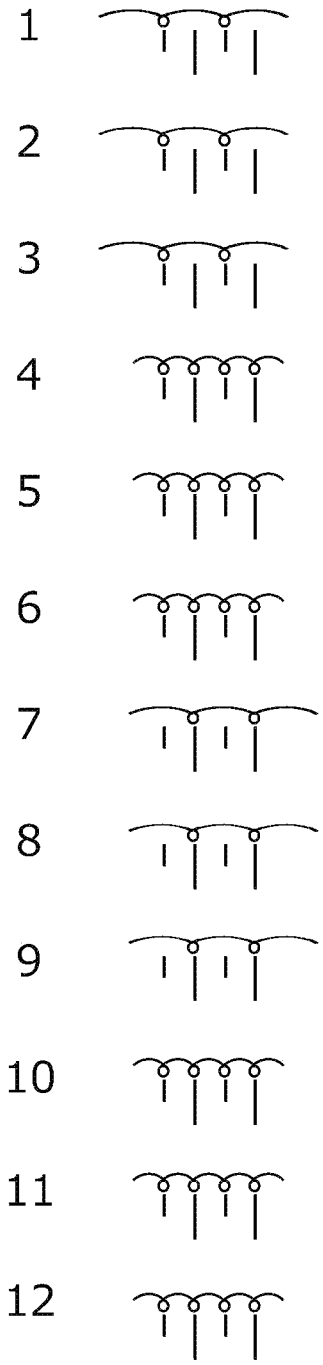
FIG. 9 is a knitting diagram for the knitted texture of Comparative Example 2.
Figure 10:
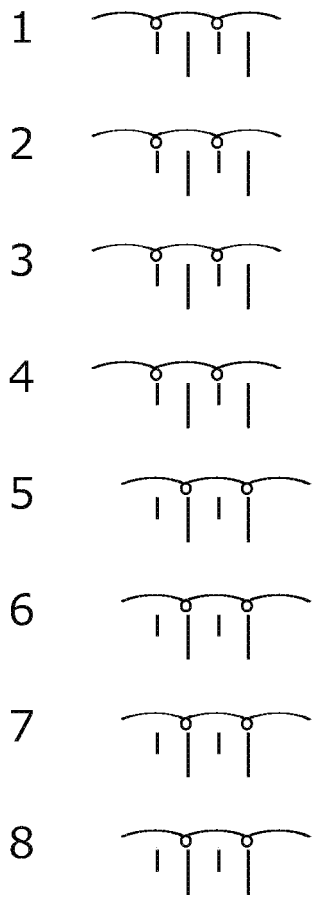
FIG. 10 is a knitting diagram for the knitted texture of Comparative Example 3.

A 24-gauge single circular knitting machine was used for knitting of a plain stitch knitted fabric according to the knitting diagram of FIG. 8, having cotton 80/1 in a completely knitted structure. The knitted fabric was relaxed and scoured with a continuous scouring machine, and then preset for 1 minute at 190° C. A knitted fabric obtained by finish setting carried out under conditions of 170° C., 1 minute without using a softener, was used for sewing of a short sleeve inner wear piece, which was then evaluated. The evaluation results are shown in Tables 1 to 3 below. The obtained knitted fabric had insufficient air permeability and ventilation was inadequate within the clothing during wear, and therefore the knitted fabric was unsuited for hot environments in which heat tends to be trapped inside clothing, while the ductility was also insufficient and the knitted fabric was uncomfortable when taken off.

Comparative Example 5

A 28-gauge single circular knitting machine was used for knitting of a plain stitch knitted fabric according to the knitting diagram of FIG. 8, having nylon 44 dtex/36 filament untwisted yarn in a completely knitted structure. The knitted fabric was relaxed and scoured with a continuous scouring machine, and then preset for 1 minute at 190° C. A knitted fabric obtained by finish setting carried out under conditions of 170° C., 1 minute without using a softener, was used for sewing of a short sleeve inner wear piece, which was then evaluated. The evaluation results are shown in Tables 1 to 3 below. The obtained knitted fabric had insufficient air permeability and ventilation was inadequate within the clothing during wear, and therefore the knitted fabric was unsuited for hot environments in which heat tends to be trapped inside clothing, while the ductility was also insufficient and the knitted fabric was uncomfortable when taken off.

TABLE 1

| | | Number of continuous courses comprising plain-knit part and mesh part | | Welt | | |
|---|---|---|---|---|---|---|
| | | Plain-knit | Mesh | structure | Yarn usage | |
| | Texture | part | part | shift | Plain-knit part | Mesh part |
| Example 1 | FIG. 3 | 1 | 1 | None | Ny 44T48f untwisted yarn Pu 22T | Ny 44T48f untwisted yarn Pu 22T |

TABLE 1-continued

Figure 4:
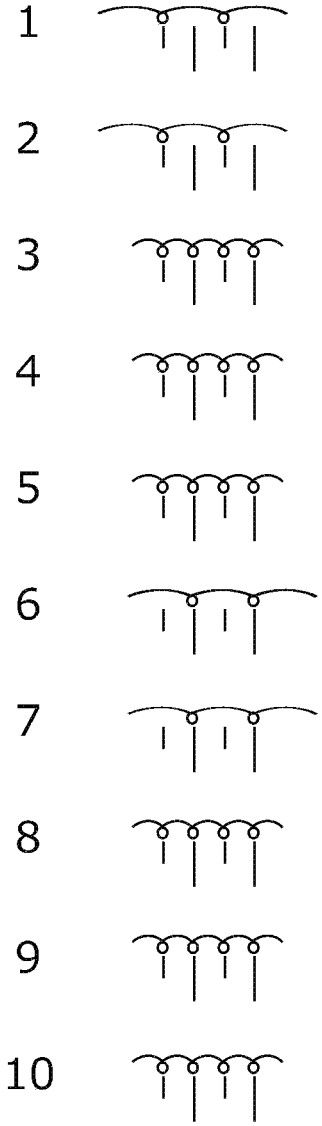
FIG. 4 is one example of a knitting diagram for a preferred knitted texture of the embodiment.
Figure 5:
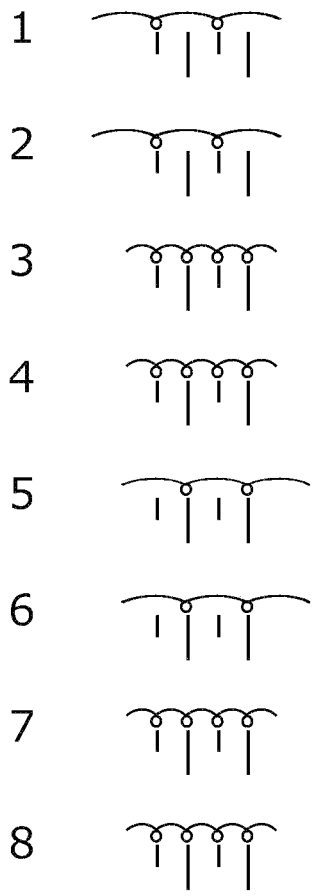
FIG. 5 is one example of a knitting diagram for a preferred knitted texture of the embodiment.
Figure 7:
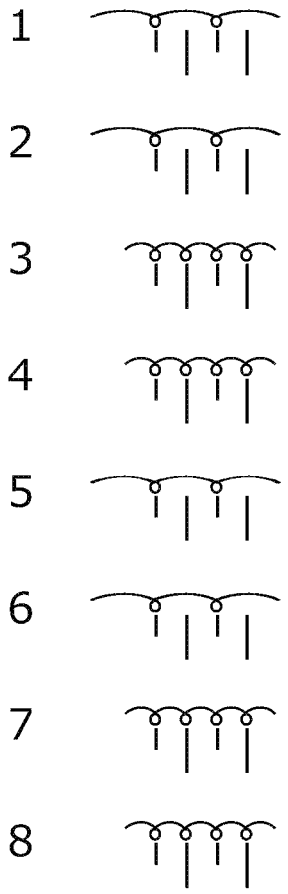
FIG. 7 is one example of a knitting diagram for a preferred knitted texture of the embodiment.

| | | | | | | |
|---|---|---|---|---|---|---|
| Example 2 | FIG. 4 | 3 | 2 | No | Ny 44T48f untwisted yarn<br>Pu 19T | Ny 44T48f untwisted yarn<br>Pu 19T |
| Example 3 | FIG. 5 | 2 | 2 | Yes | Es 33T36f untwisted yarn<br>Pu 19T | Es 33T36f untwisted yarn<br>Pu 19T |
| Example 4 | FIG. 3 | 1 | 1 | No | Ny 44T48f untwisted yarn<br>Pu 19T | Ny 44T48f untwisted yarn |
| Example 5 | FIG. 6 | 1 | 1 | Yes | Ny 44T48f 1200T/m<br>Pu 19T | Ny 44T48f 1200T/m |
| Example 6 | FIG. 7 | 2 | 2 | No | Ny 44T48f 100T/m<br>Cu33T24f* Ny13T7f<br>Pu 19T | Ny 44T48f 100T/m<br>Cu33T24f* Ny13T7f |
| Example 7 | FIG. 7 | 2 | 2 | No | Ny 44T48f 1000T/m<br>Pu 19T | Ny 44T48f 1000T/m |
| Example 8 | FIG. 5 | 2 | 2 | Yes | Ny 44T34f 500T/m<br>Pu 19T | Ny 44T34f 500T/m |
| Example 9 | FIG. 5 | 2 | 2 | Yes | Winding yarn: Ny 44T36f<br>Core yarn: Pu 33T | Winding yarn: Ny 44T36f<br>Core yarn: Pu 33T |
| Example 10 | FIG. 6 | 1 | 1 | Yes | Ny 44T48f 1200T/mPu 19T | Ny 44T48f 1200T/m |
| Example 11 | FIG. 6 | 1 | 1 | Yes | Winding yarn: Ny 44T36f<br>Core yarn: Pu 33T | Ny 44T48f 1200T/m |
| Comp. Example 1 | FIG. 8 | 1 | 0 | No | Ny 33T26f untwisted yarn<br>Pu 19T | — |
| Comp. Example 2 | FIG. 9 | 3 | 3 | Yes | Ny 3 3T26f untwisted yarn<br>Pu 19T | Ny 33T26f untwisted yarn<br>Pu 19T |
| Comp. Example 3 | FIG. 10 | 0 | 4 | Yes | — | Ny 44t48f 500T/mCu<br>33T26f Pu 19T |
| Comp. Example 4 | FIG. 8 | 1 | 0 | No | Cotton 80/1 100% | — |
| Comp. Example 5 | FIG. 8 | 1 | 0 | No | Ny 44T48f untwisted yarn | — |

| | Non-elastic fiber or composite yarn loop length (mm/100 w) | | Non-elastic fiber loop yarn length ratio (mesh part/plain-knit part) | Elastic fiber loop length (mm/100 w) | | Elastic fiber loop length ratio (elastic fiber/non-elastic fiber) | |
|---|---|---|---|---|---|---|---|
| | Plain-knit part | Mesh part | | Plain-knit part | Mesh part | Plain-knit part | Mesh part |
| Example 1 | 170 | 123 | 0.72 | 56.7 | 41 | 0.30 | 0.30 |
| Example 2 | 232 | 149 | 0.64 | 69 | 52 | 0.31 | 0.35 |
| Example 3 | 225 | 137 | 0.61 | 61 | 52 | 0.27 | 0.38 |
| Example 4 | 211 | 160 | 0.76 | 69 | — | 0.33 | — |
| Example 5 | 193 | 139 | 0.72 | 50 | — | 0.26 | — |
| Example 6 | 211 | 160 | 0.76 | 69 | — | 0.33 | — |
| Example 7 | 240 | 197 | 0.82 | 77 | — | 0.32 | — |
| Example 8 | 196 | 141 | 0.72 | 56.7 | — | 0.29 | — |
| Example 9 | 285 | 231 | 0.81 | — | — | — | — |
| Example 10 | 179 | 120 | 0.67 | 50 | — | 0.28 | — |
| Example 11 | 285 | 230 | 0.83 | — | — | — | — |
| Comp. Example 1 | 170 | — | — | 52 | — | 0.31 | — |
| Comp. Example 2 | 211 | 160 | 0.76 | 69 | 52 | 0.33 | 0.33 |
| Comp. Example 3 | — | 182 | — | — | 61 | — | 0.34 |
| Comp. Example 4 | 280 | — | — | — | — | — | — |
| Comp. Example 5 | 210 | — | — | — | — | — | — |

TABLE 2

| | Number of courses (course/inch) | Number of wales (wale/inch) | Knitting machine gauge | Basis weight ($g/m^2$) | Thickness (mm) | Air permeation volume ($cc/cm^2/s$) (not-stretched) | Air permeation volume ($cc/cm^2/s$) (10% elongation warp and weft) | DHL ($W/m^2 \cdot ° C.$) | Residual moisture after 60 minutes (%) |
|---|---|---|---|---|---|---|---|---|---|
| Example 1 | 121 | 58 | 40 | 91 | 0.39 | 270 | 353 | 11.0 | 2.7 |
| Example 2 | 132 | 60 | 36 | 108 | 0.50 | 209 | 328 | 10.1 | 2.3 |
| Example 3 | 90 | 57 | 36 | 89 | 0.46 | 250 | 390 | 10.3 | 1.6 |
| Example 4 | 112 | 55 | 36 | 72 | 0.33 | 270 | ≥430 | 11.1 | 1.8 |
| Example 5 | 113 | 54 | 36 | 74 | 0.33 | 270 | ≥430 | 11.0 | 3.5 |
| Example 6 | 128 | 57 | 36 | 89 | 0.50 | 364 | ≥430 | 11.1 | 16.9 |
| Example 7 | 130 | 58 | 32 | 85 | 0.43 | 348 | ≥430 | 11.1 | 1.9 |
| Example 8 | 90 | 54 | 36 | 85 | 0.39 | ≥430 | ≥430 | 11.3 | 1.8 |
| Example 9 | 110 | 52 | 28 | 127 | 0.67 | 211 | 312 | 10.1 | 25.9 |
| Example 10 | 138 | 72 | 36 | 121 | 0.61 | 158 | 220 | 9.5 | 2.8 |
| Example 11 | 134 | 68 | 36 | 115 | 0.59 | 141 | 238 | 9.8 | 29.2 |

TABLE 2-continued

| | Number of courses (course/inch) | Number of wales (wale/inch) | Knitting machine gauge | Basis weight ($g/m^2$) | Thickness (mm) | Air permeation volume ($cc/cm^2/s$) (not-stretched) | Air permeation volume ($cc/cm^2/s$) (10% elongation warp and weft) | DHL ($W/m^2 \cdot ° C.$) | Residual moisture after 60 minutes (%) |
|---|---|---|---|---|---|---|---|---|---|
| Comparative Example 1 | 122 | 62 | 40 | 85 | 0.47 | 95 | 182 | 8.4 | 2.9 |
| Comparative Example 2 | 142 | 62 | 36 | 85 | 0.51 | 74 | 142 | 8.9 | 4.4 |
| Comparative Example 3 | 111 | 68 | 32 | 85 | 0.55 | 71 | 165 | 8.2 | 27.3 |
| Comparative Example 4 | 42 | 36 | 24 | 85 | 0.55 | 153 | 10% elongation not possible | 9.4 | 41.2 |
| Comparative Example 5 | 82 | 56 | 28 | 94 | 0.46 | 148 | 219 | 8.3 | 5.7 |

TABLE 3

| | Q-max ($W/m^2 \cdot ° C.$) | | Snagging | | | | Elongation properties | |
|---|---|---|---|---|---|---|---|---|
| | | | Needle side | | Sinker side | | Warp direction | |
| | | | | | | | 40% | |
| | Needle side | Sinker side | Warp direction | Weft direction | Warp direction | Weft direction | Elongation load (cN) | Recovery factor (%) |
| Example 1 | 121 | 112 | Grade 4 | Grade 4 | Grade 4 | Grade 4 | 37.8 | 80 |
| Example 2 | 145 | 120 | Grade 4 | Grade 4 | Grade 3 | Grade 3 | 27.5 | 83 |
| Example 3 | 137 | 112 | Grade 4 | Grade 4 | Grade 3 | Grade 3 | 35.4 | 82 |
| Example 4 | 106 | 106 | Grade 4 | Grade 4 | Grade 3 | Grade 3 | 28.2 | 83 |
| Example 5 | 113 | 111 | Grade 4 | Grade 4 | Grade 4 | Grade 4 | 39.1 | 86 |
| Example 6 | 110 | 105 | Grade 4 | Grade 4 | Grade 3.5 | Grade 3.5 | 33.7 | 84 |
| Example 7 | 105 | 115 | Grade 4 | Grade 4 | Grade 4 | Grade 4 | 33.9 | 84 |
| Example 8 | 121 | 124 | Grade 4 | Grade 4 | Grade 4 | Grade 4 | 41.1 | 81 |
| Example 9 | 109 | 103 | Grade 4 | Grade 4 | Grade 4 | Grade 4 | 20.2 | 81 |
| Example 10 | 113 | 111 | Grade 4 | Grade 4 | Grade 3 | Grade 3 | 34.4 | 89 |
| Example 11 | 101 | 112 | Grade 4 | Grade 4 | Grade 4 | Grade 4 | 30.2 | 80 |
| Comp. Example 1 | 138 | 154 | Grade 4 | Grade 4 | Grade 4 | Grade 4 | 34.1 | 86 |
| Comp. Example 2 | 138 | 146 | Grade 2 | Grade 2 | Grade 1 | Grade 1 | 33.0 | 86 |
| Comp. Example 3 | 134 | 136 | Grade 2 | Grade 2 | Grade 1 | Grade 1 | 51.2 | 78 |
| Comp. Example 4 | 106 | 106 | Grade 4 | Grade 4 | Grade 4 | Grade 4 | 20% elongation not possible, unmeasurable | |
| Comp. Example 5 | 127 | 103 | Grade 4 | Grade 4 | Grade 4 | Grade 4 | 181.7 | 66 |

| | Elongation properties Weft direction | | Wearability/comfort | | |
|---|---|---|---|---|---|
| | 40% Elongation load (cN) | Recovery factor (%) | Wearability | Comfort immediately after being put on | Comfort when worn |
| Example 1 | 62.9 | 84 | 4.6 | 4.4 | 4.3 |
| Example 2 | 57.8 | 82 | 4.7 | 4.5 | 4.3 |
| Example 3 | 63.1 | 86 | 4.6 | 4.4 | 4.5 |
| Example 4 | 58.7 | 89 | 4.7 | 4.3 | 4.6 |
| Example 5 | 58.8 | 82 | 4.7 | 4.6 | 4.6 |
| Example 6 | 59.3 | 81 | 4.7 | 4.6 | 4.8 |
| Example 7 | 55.3 | 81 | 4.7 | 4.6 | 4.8 |
| Example 8 | 56.6 | 84 | 4.7 | 4.7 | 4.8 |
| Example 9 | 45.6 | 82 | 4.7 | 4.2 | 4.2 |
| Example 10 | 49.2 | 83 | 4.4 | 4.3 | 4.0 |
| Example 11 | 44.2 | 82 | 4.4 | 4.2 | 4.0 |
| Comp. Example 1 | 45.6 | 83 | 4.3 | 4.4 | 3.4 |
| Comp. Example 2 | 71.2 | 81 | 3.4 | 4.4 | 3.8 |
| Comp. Example 3 | 81.1 | 77 | 3.3 | 4.2 | 3 |
| Comp. Example 4 | 20% elongation not possible, unmeasurable | | 3 | 3.9 | 2.5 |
| Comp. Example 5 | 93.3 | 71 | 3.1 | 3.9 | 2.4 |

INDUSTRIAL APPLICABILITY

The weft-knitted fabric of the present invention has excellent stretch properties and excellent comfort in hot environments, and therefore when used to sew clothing such as inner clothing or sports wear that is expected to be worn in hot environments, the clothing has a movement-following property due to its high stretchability, and also excellent wearability, without producing a feeling of mustiness by sweat produced in hot environments.

The invention claimed is:

1. A weft-knitted fabric comprising non-elastic fibers and elastic fibers, composed of a mesh part in which a course having alternate repetition of a stitch of a welt structure and a stitch of a knit structure is used with continuous knitting of 1-2 courses in the same structural arrangement, and a plain-knit part in which a course having an all-knit structure is used with continuous knitting of 1-3 courses, and the mesh part and plain-knit part are each alternately knitted in the warp direction, and the elastic fibers are contained only in the plain-knit part.

2. The weft-knitted fabric according to claim 1, wherein the air permeability according to JIS-L-1096—Air Permeability Method A (Frajour type method) is 200 $cc/cm^2/s$ or greater.

3. The weft-knitted fabric according to claim 1, wherein the stitch density is 80 to 135 course/inch.

4. The weft-knitted fabric according to claim 1, wherein the plain-knit part has continuous knitting of 1-2 courses.

5. The weft-knitted fabric according to claim 1, wherein the non-elastic fibers are twisted threads.

6. The weft-knitted fabric according to claim 1, wherein in the mesh part, a course having alternate repetition of a stitch of a welt structure and a stitch of a knit structure is used with continuous knitting of 2 courses in the same structural arrangement, and in the plain-knit part, a course having an all-knit structure is used with continuous knitting of 2 courses.

7. The weft-knitted fabric according to claim 1, wherein the welt structure of the mesh part and the welt structure of the mesh part adjacent to that mesh part across the plain-knit part, are not on the same wale.

8. The weft-knitted fabric according to claim 1, wherein the elastic fibers are bare threads that are not covered with non-elastic fibers.

9. A weft-knitted fabric according to claim 1, which is a circular knitted fabric.

* * * * *